United States Patent [19]

Carlo

[11] 4,069,524

[45] Jan. 24, 1978

[54] COLLAPSIBLE CHILD PEN WITH IMPROVED HINGE JOINT

[75] Inventor: Louis David Carlo, Valley City, Ohio

[73] Assignee: Century Products Inc., Cleveland, Ohio

[21] Appl. No.: 712,604

[22] Filed: Aug. 9, 1976

[51] Int. Cl.[2] ..... A47C 27/08

[52] U.S. Cl. ..... 5/99 B; 5/99 R

[58] Field of Search ..... 5/93, 98 R, 99 R, 99 A, 5/99 B, 110, 111, 114, 127; 403/113, 115, 114, 117, 161

[56] References Cited

U.S. PATENT DOCUMENTS

| | | | |
|---|---|---|---|
| 3,034,809 | 5/1962 | Greenberg | 403/117 |
| 3,092,847 | 6/1963 | De Puy | 5/98 R |
| 3,186,736 | 6/1965 | Warshawsky | 403/117 |
| 3,638,243 | 2/1972 | Campbell et al. | 403/115 |

*Primary Examiner*—Casmir A. Nunberg

[57] ABSTRACT

An improved hinge joint construction for a collapsible child pen. A longitudinally extending yoke member includes means defining an opening in a longitudinal end thereof. A longitudinally extending rod member has a longitudinal end portion disposed partially within the opening and which is adapted to be pivoted relative to the yoke member in a direction bringing the rod member into longitudinal alignment with the yoke member during assembling of the structure. A cap member is interconnected with the yoke member for rotation about an axis which is fixed with respect to the yoke member, and the yoke member defines means for resisting movement of the cap member in the direction of the axis. The cap member is interconnected with the longitudinal end of the rod member to support the rod member for pivotal movement about the axis. The cap member also includes an outer surface disposed at least partially within said opening and which is movable along a path disposed in covering relation to the opening in the yoke member to prevent longitudinal insertion of a member other than said rod through the opening during movement of the rod member from collapsed position to assembled position.

7 Claims, 5 Drawing Figures

COLLAPSIBLE CHILD PEN WITH IMPROVED HINGE JOINT

BACKGROUND OF THE INVENTION

This application relates generally to a collapsible child pen. For purposes of this disclosure the term "child pen" is defined as any structure which functions to contain, in the sense of establishing metes and bounds, a child in the conduct of its various activities, e.g., playing, sleeping, etc. By way of examples, such structures include playpens, cribs, car beds, carriages and the like.

A collapsible child pen generally includes longitudinally extending structural members which are pivotably mounted relative to one another and which are pivoted relative to one another as the pen is assembled or collapsed. The invention relates particularly to a hinge joint construction for interconnecting a longitudinally extending yoke member and a longitudinally extending rod member adapted for pivotal movement relative to the yoke member as the pen is assembled.

In a collapsible child pen it is conventional to provide a yoke member and a longitudinally extending rod member having a longitudinal end which extends through an opening in a longitudinal end of the yoke and is at least partially enclosed by the yoke. It is also conventional to pivotally interconnect these members by means of a pin which is journaled in a portion of the yoke member and which extends through portions of the rod member is generally pivoted into a longitudinally coextensive orientation relative to the yoke member by means of a pivotal linkage which pivots to an over-center position to continually held the rod member in the longitudinally coextensive orientation . A surface of the yoke member engages the rod member to limit pivotal movement of the rod member past the longitudinally coextensive position.

In such a collapsible pen it has been conventional for many years to construct the rod member with a small enough cross section that it can pivot to a sufficient extent relative to the yoke to collapse and reassemble the pen. In doing so there is generally provided a gap between the outer surface of the rod and the portion of the yoke defining the opening. This gap is wide enough for insertion of a person's finger, particularly a child's finger, through the opening as the structure is assembled. The rod member is generally much greater in length than the yoke, and is urged toward longitudinally coextensive relation with the yoke with great force as the pivotal linkage pivots to its over-center position. This is a potential source of great danger to a person whose finger is inadvertently in that gap when the pen is assembled. In fact, this type of situation has been so dangerous that there have been actual amputations of fingers in such joints.

The child products industry has long recognized the potential hazard which such joints create. The basic response of the industry to this hazard, and which response has served as the standard construction in playards for many years, has been to provide a fabric cover over the junction of the yoke and the rod member, with the cover intended to block insertion of the assembler's fingers in the gap in the hinge joint. Finger guards, per se, have also been suggested for many years for doors and window frames, as shown for example in disclosures such as French Patent Nos. 1,310,605 and 765,310, U.S. Pat. No. 2,597,174 and German Pat. Nos. 295,693 and 216,816. These disclosures do not relate to hinges for collapsible child pen and moreover do not suggest the specific hinge construction of the present invention.

SUMMARY OF THE INVENTION

The present invention relates to a hinge joint for a collapsible child pen, which hinge joint is designed to allow the rod member and yoke member to pivot into an assembled condition and which serves to substantially minimize the likelihood of injury to the assembler. According to the invention a collapsible child pen includes a longitudinally extending yoke member and a longitudinally extending rod member which are adapted to pivot relative to one another toward longitudinally coextensive orientation as the pen is assembled. The yoke member includes an opening at a longitudinal end thereof. A cap member is interconnected with the yoke member and is supported for rotation relative to the yoke member and about an axis which is fixed with respect to the yoke member. The yoke member also defines means which resist movement of the cap member in the direction of the axis.

Means are provided for connecting the longitudinal end portion of the rod with the cap to mount the longitudinal end of the rod for pivotal movement about the axis which is fixed with respect to the yoke. The outer surface of the cap member includes a spherically shaped portion disposed at least partially within the opening in the yoke and which is movable along a path which disposes it in covering relation to said opening as the rod member and yoke member are moved toward longitudinally coextensive orientation. The cap member is dimensioned so that during such movement the outer surface forms a continuous surface forming a barrier to longitudinal insertion of a member through the opening in the yoke as the pen is assembled.

The hinge joint of the present invention essentially provides a yoke member and cap member interconnected and adapted for a predetermined type of relative movement and a rod member which is pivotally connected to the yoke through its connection to the cap member.

BRIEF DESCRIPTION OF THE DRAWINGS

The further objects and advantages of the present invention will become further apparent from the following detailed description taken with reference to the accompanying drawings wherein.

DETAILED DESCRIPTION OF THE PREFERRED EMBODIMENT

As noted above the present invention relates to a hinge joint structure for a collapsible child pen which provides a confined area which establishes metes and bounds for the conduct of a child in its various activities. In the description which follows the principles of the invention are described as they are applied in the construction of the type of collapsible child pen commonly known as a playard. However, from the enclosed description the manner in which the present invention can be applied to numerous comparable collapsible child pens (such as collapsible beds) will become readily apparent to those of ordinary skill in the art.

Figure 1:
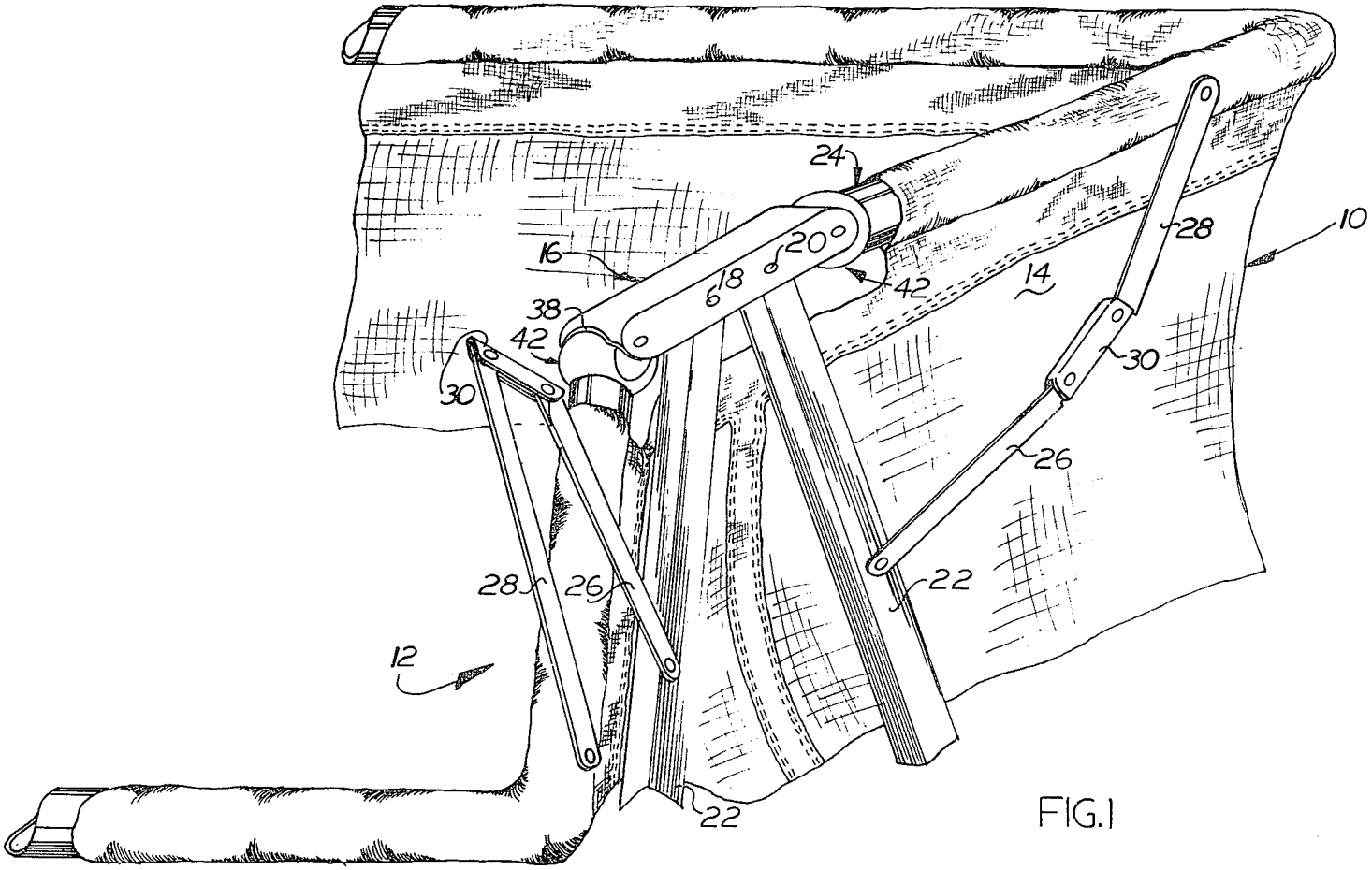
FIG. 1 is a partial perspective view of a child's playard constructed with a hinge joint in accordance with the principles of the present invention.

Referring to FIG. 1, a playard includes a first side 10 which is shown in its assembled condition and a second side 12 which is shown in a disassembled, or collapsed, condition. When the playard is assembled a mesh or fabric siding 14 is supported in a vertically upstanding position relative to the bottom surface (not shown) of the playard.

A longitudinally extending yoke member 16 has two pairs of aligned bores 18, 20 intermediate its longitudinal ends. Pin means are provided for connecting an end of each of a pair of leg members 22 to the yoke member 16 by engagement with bores 18, 20. The other end of each leg member 22 includes either appropriate rollers or end fittings for supporting the playard on the floor.

The mesh or fabric 14 has a portion disposed about a rod member 24 (preferably a length of hollow metal tubing). The rod member 24 is adapted for pivotal movement relative to each longitudinal end of the yoke member 16 in the manner to be set forth more fully hereinafter. A linkage is provided and includes a first member 26 having a first end pivotally connected to a leg member 22 and a second member 28 having a first end pivotally connected to a respective rod member 24. The linkage further includes a yoke 30 pivotally connected to the second ends of members 26 and 28. When the playard is assembled the linkage is moved from the collapsed position shown at 12 in FIG. 1 in an over-center manner (to the positions shown at 10) to maintain the leg member and the respective rod member in assembled condition.

The yoke member 16 illustrated is a longitudinally extending homogeneous member (preferably snythetic plastic) having a cross section which is generally in the shape of an inverted U. The yoke member 16 includes a pair of parallel inner surface portions 32, 34 and a concave surface 36 portion joining the parallel surface portions. Each longitudinal end of the yoke member is slightly rounded and forms a stop surface 38 whose function will become more apparent hereinafter. The yoke member 16 defines an opening 40 in each of its longitudinal ends.

In accordance with the present invention a cap member 42 is disposed at least partially within the opening in each longitudinal end of the yoke member. Each cap member 42 is preferably a solid plastic member having an outer configuration defining a pair of parallel side walls 44, 46 whose spacing is approximately equal to the spacing between the parallel surface portions 32, 34 of the yoke member. The cap member 42 further includes a spherical outer surface portion 48.

The cap member 42 is interconnected with the yoke member 16 and supported for rotation relative to the yoke member about an axis 43 which is fixed with respect to the yoke member. Referring to the illustrations the surface portions 32, 34 of the yoke member include a pair of axially aligned bores 50, 52. Cap member 42 also includes a pair of axially aligned bores (not shown). A pin member 54 extends through the bores of the yoke member and the cap member to pivotally support the cap member for rotation relative to the yoke member about a fixed axis relative to the yoke member. The cap member is dimensioned so that as it rotates relative to the yoke member its spherical outer surface portion 48 passes in close proximity to the stop surface 38 of the yoke member moves along a path which is external to the yoke member.

Figure 3:
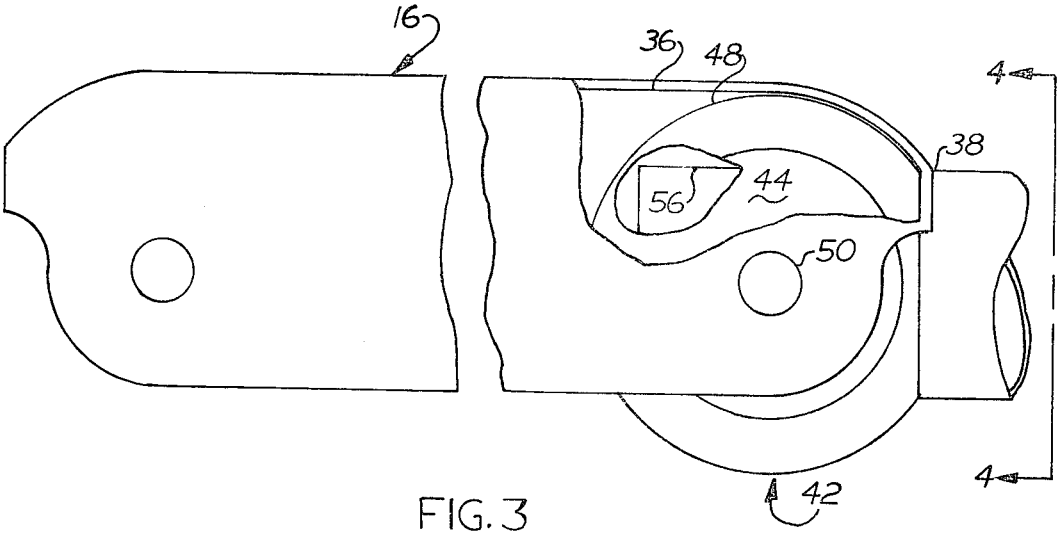
FIG. 3 is a side view of a hinge joint constructed in accordance with the principles of the present invention with portions broken away.
Figure 4:
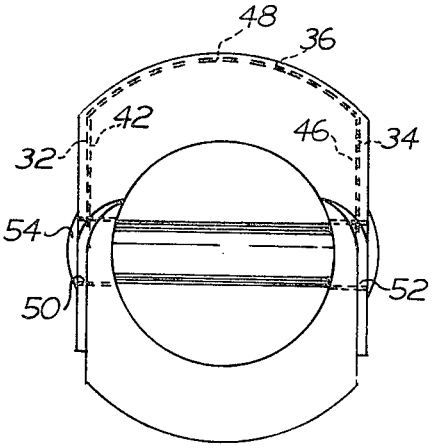
FIG. 4 is an end view of the hinge joint of FIG. 3, taken from the direction 4—4.

The rod member 24 is connected to the cap member 42 and mounted for pivotal movement about the axis which is fixed relative to the yoke member. As seen in FIGS. 3 and 4 the cap member 42 includes a cylindrical bore 56 formed therein. Cylindrical bore 56 has a diameter which is just slightly larger than the diameter of the rod.

In the illustrated embodiment rod member 24 extends into an opening 40 and into the bore 56 formed in the cap member. The rod member 24 also includes a pair of axially aligned holes and the pin member 54 also passes through the holes. With this construction the pin 54 serves to pivotally connect the cap member to the yoke. The interengagement of the rod member 24 and the bore 56, and the pin member 54 also passing through the rod member serves to connect the rod member to the cap member for rotation therewith.

It is further contemplated that the cap member could be secured to the yoke member for rotation about a fixed axis through extensions which are formed integrally with cap member 42 and which extend outwardly of the parallel side surfaces 44, 46 of the cap member and which engage the axially aligned bores 32, 34 in the yoke member. In this construction the cap member would include a bore such as 56 but dimensioned to receive the rod member in a tight fit so that they rotate together. Alternatively, some additional form of adhesive or other securing means would be provided between the rod member and the cap member so that they rotate together. In yet another contemplated modification of this invention the yoke member and the cap member which are both preferably formed of plastic might be integrally formed with the cap member joined to the yoke member for rotation by an integrally formed "living" hinge construction, which is a known form of hinge construction.

In its collapsed condition the hinge joint members are in the positions illustrated at 12 in FIG. 1. As a rod member 24 is pivoted toward longitudinally coextensive orientation with the yoke member the linkage members 26, 28 and 30 are moved from the positions shown at 12, to the positions illustrated in FIG. 2 and then over-center to the assembled condition position shown at 10 in FIG. 1 with the rod member and yoke member in longitudinally coextensive orientation.

As the rod member and yoke member move toward longitudinally coextensive orientation the stop surface 38 on the yoke member engages the outer surface 58 of the rod member 24 to block relative movement of the rod member and yoke member past the longitudinally coextensive orientation. The linkage member 26,28,30, being moved to an outer-center relation acts to hold the rod member and yoke member in longitudinally coextensive orientation until sufficient force is applied to collapse the structure.

Figure 2:
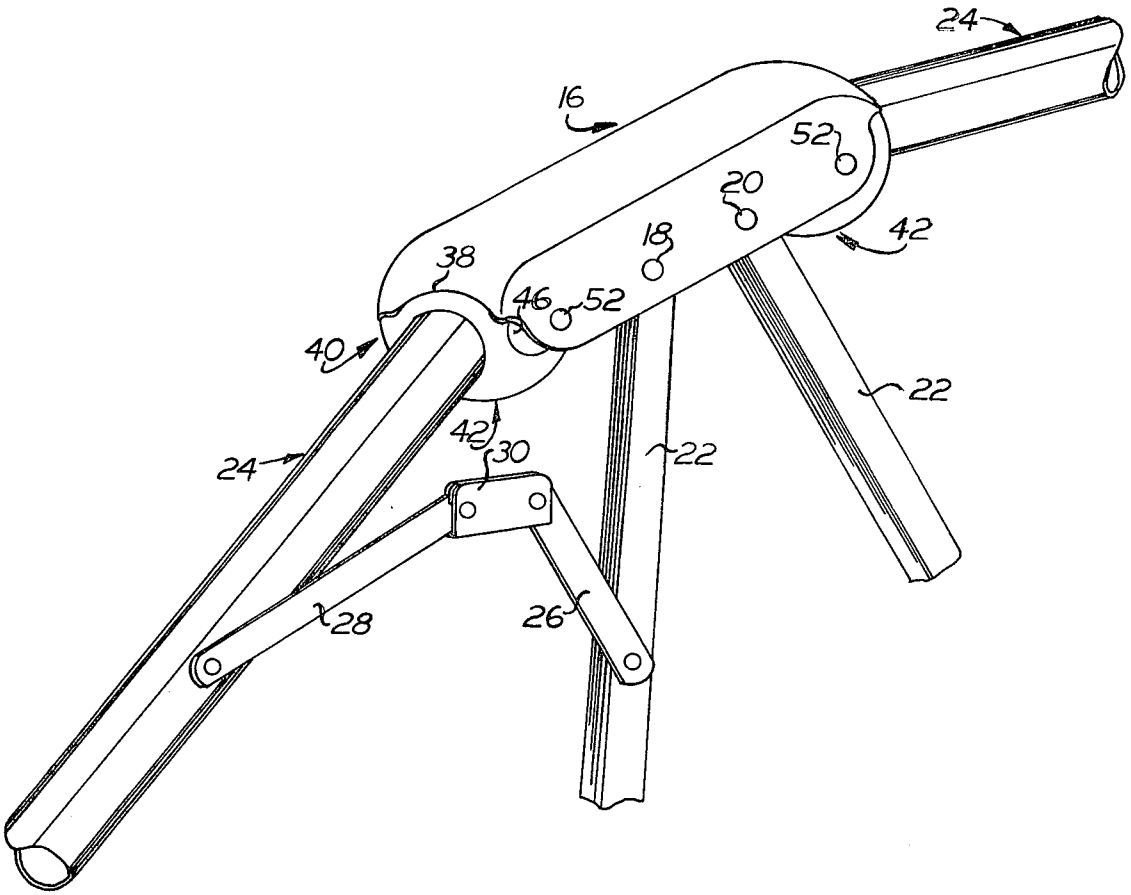
FIG. 2 is a perspective view of the hinge joint of FIG. 1, and in a different position than the hinge joint of FIG. 1.

Referring to FIGS. 1 and 2, the spherically shaped outer surface of the cap member 42 is disposed in covering relation to the opening 40 as the rod member is moved from its collapsed position to its assembled position. This means that longitudinal insertion of a member (such as a person's finger) through the opening 42 is prevented.

By the aforesaid construction the cap member forms a barrier against insertion of a person's finger through the longitudinal end of the yoke member even when the playard is in a collapsed position. This markedly reduces the risk of an extreme lever action being exerted against a portion of the person's finger as the structure is moved into assembled condition.

Figure 5:
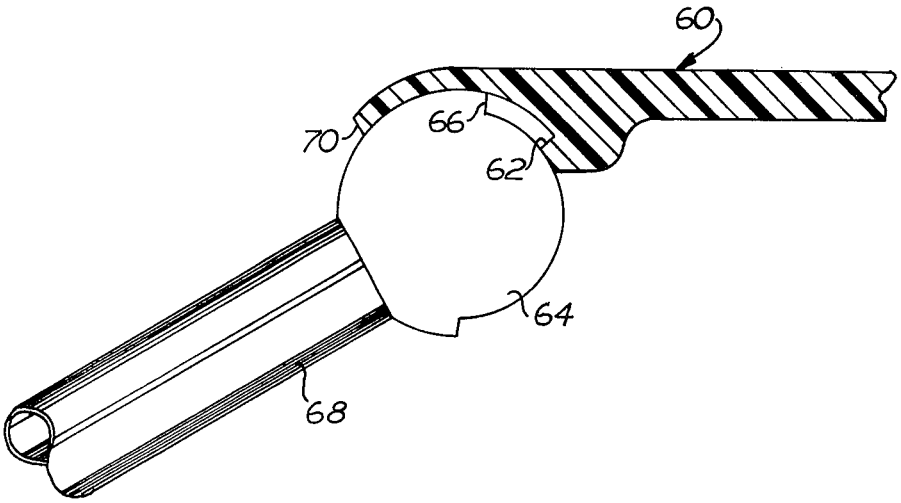
FIG. 5 is a side view of a portion of a hinge joint constructed in accordance with modified form of the present invention with a portion of the yoke member shown in section.

In another modified form of the principles of the present invention the means for stopping relative pivotal movement of the rod member and the yoke member in longitudinally coextensive orientation may be formed on both the cap member and the yoke member. Referring to FIG. 5 the yoke member 60 includes stop member 62 integrally formed therewith. The cap member 64 also includes a stop 66 integrally formed therewith. As the rod member 68 and yoke member 60 are rotated toward longitudinally coextensive orientation the stop members 62, 66 engage each other to limit further rotation in that direction. With this construction any potential pinch points which may exist between the yoke surface 70 and the rod member are further eliminated since the stop members 62, 66 are designed to engage each other before the surface 70 of the yoke member engages the rod member.

Thus, by virtue of the foregoing description there has been disclosed a hinge joint for a collapsible child pen which is believed to be easy and inexpensive to form and which is believed to provide an extremely effective and safe hinge between a yoke member and a rod member. With the foregoing description in mind obvious modifications of the principles of this invention will become apparent to those of ordinary skill in the art.

What is claimed is:

1. In a child pen comprising a collapsible structure having a plurality of structural members which are coupled to one another and which are moveable relative to one another to assemble the structure from a collapsed condition and to collapse the structure from an assembled condition, the improvement comprising a hinge joint comprising a longitudinally extending yoke member including means defining an opening in a longitudinal end thereof, a longitudinally extending rod member having a longitudinal end portion disposed partially within said opening in said yoke, the longitudinal axes of said yoke and said rod member lying in a substantially common plane, means forming a pivot axis extending normal to the longitudinal axis of the rod member, means supporting said pivot axis in a fixed position with respect to said yoke member, said rod member being supported for pivotal movement in a first direction about said pivot axis during assembling of the structure whereby said rod member is brought into longitudinal alignment with said yoke member and in a second direction about said axis during collapsing of said structure, a cap member interconnected with said yoke member and said pivot axis and supported for pivotal movement about said pivot axis during assembly and collapse of said structure, said yoke defining means for resisting movement of said cap member in the direction of said pivot axis, means for interconnecting said cap member and said longitudinal end of said rod member for joint pivotal movement about said pivot axis during assembly and collapse of said structure, said cap member including outer surface means disposed at least partially within said opening and moveable along a path disposed in covering relation to said opening to prevent longitudinal insertion of a human limb such as a finger into said opening during pivotal movement of said rod member from said collapsed condition to said assembled condition.

2. The child pen as defined by claim 1 wherein said cap member comprises an outer surface defining a spherically shaped portion and a pair of flat portions, said yoke member defines a pair of flat wall portions facing said flat portions of said cap member, said cap member defines recess means for receiving said longitudinal end portion of said rod member, and said means forming a pivot axis comprises pin means journaled for rotation in said flat wall portions and journaled for rotation in said flat portions of said cap member.

3. In a child pen as defined in claim 2 wherein said pin means is also journaled in said rod member.

4. The child pen as defined in claim 1 wherein said means forming a pivot axis includes pin means extending outwardly of said outer surface of said cap member and being connected with said yoke member for supporting said cap member for rotation about said pivot axis.

5. The child pen as defined in claim 1 wherein said yoke member comprises a pair of coaxial bushings, and said means forming said pivot axis comprises pin means extending outwardly of said outer surface of said cap member and rotatably received by said bushings to support said cap member for rotation about said pivot axis.

6. In a child pen as defined in claim 5 wherein said pin means extends through said cap member and through said rod member.

7. In a child pen as defined in claim 1 further including first stop means integrally formed with said cap member and second stop means integrally formed with said yoke member, said first and second stop means being engageable during rotation of said cap member in one direction to limit relative rotation of the yoke member and the rod member in a longitudinally coextensive orientation.

* * * * *